US011697782B2

(12) United States Patent
Junuzovic et al.

(10) Patent No.: US 11,697,782 B2
(45) Date of Patent: Jul. 11, 2023

(54) ENGINE OIL LUBRICANT COMPOSITIONS AND METHODS FOR MAKING SAME WITH SUPERIOR ENGINE WEAR PROTECTION AND CORROSION PROTECTION

(71) Applicant: EXXONMOBIL TECHNOLOGY AND ENGINEERING COMPANY, Annandale, NJ (US)

(72) Inventors: Haris Junuzovic, Hamburg (DE); Douglas E. Deckman, Easton, PA (US); Benjamin D. Eirich, Frenchtown, NJ (US)

(73) Assignee: EXXONMOBIL TECHNOLOGY AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 17/341,816

(22) Filed: Jun. 8, 2021

(65) Prior Publication Data

US 2022/0010230 A1 Jan. 13, 2022

Related U.S. Application Data

(60) Provisional application No. 63/049,742, filed on Jul. 9, 2020.

(51) Int. Cl.

| | |
|---|---|
| ***C10M 145/28*** | (2006.01) |
| ***C10M 129/74*** | (2006.01) |
| ***C10M 169/04*** | (2006.01) |
| *C10N 30/00* | (2006.01) |
| *C10N 40/25* | (2006.01) |
| *C10N 20/02* | (2006.01) |
| *C10N 30/02* | (2006.01) |
| *C10N 30/06* | (2006.01) |
| *C10N 30/12* | (2006.01) |

(52) U.S. Cl.

CPC ..... *C10M 145/28* (2013.01); *C10M 129/74* (2013.01); *C10M 169/04* (2013.01); *C10M 2205/04* (2013.01); *C10M 2205/06* (2013.01); *C10M 2207/283* (2013.01); *C10M 2209/104* (2013.01); *C10N 2020/02* (2013.01); *C10N 2030/02* (2013.01); *C10N 2030/06* (2013.01); *C10N 2030/12* (2013.01); *C10N 2030/54* (2020.05); *C10N 2040/252* (2020.05); *C10N 2040/255* (2020.05)

(58) Field of Classification Search

CPC ..... C10M 145/28; C10M 129/74; C10M 169/04; C10M 2205/04; C10M 2205/06; C10M 2207/283; C10M 2209/104; C10N 2030/06; C10N 2040/04; C10N 2040/25; C10N 2020/02; C10N 2030/02; C10N 2030/12; C10N 2030/54; C10N 2040/252; C10N 2040/255

See application file for complete search history.

(56) References Cited

U.S. PATENT DOCUMENTS

| | | | | |
|---|---|---|---|---|
| 9,228,152 | B2 | 1/2016 | Thompson et al. | |
| 9,637,702 | B2 | 5/2017 | Lancon | |
| 10,889,777 | B2 * | 1/2021 | Hutchison | C10M 111/04 |
| 11,041,137 | B2 | 6/2021 | Chen et al. | |
| 11,130,927 | B2 | 9/2021 | Horita et al. | |
| 2003/0166476 | A1 * | 9/2003 | Winemiller | C10M 105/38 508/486 |
| 2010/0101518 | A1 * | 4/2010 | Bardasz | C10M 169/045 508/463 |
| 2012/0329691 | A1 * | 12/2012 | Delbridge | C10M 169/04 508/391 |
| 2013/0274161 | A1 * | 10/2013 | Woodward | C10M 161/00 508/306 |
| 2014/0274850 | A1 * | 9/2014 | Sutton | C10M 143/00 508/591 |
| 2015/0191671 | A1 * | 7/2015 | Mayernick | C10M 169/04 508/517 |
| 2016/0122680 | A1 * | 5/2016 | Watts | C10M 161/00 508/198 |
| 2016/0264907 | A1 | 9/2016 | Chen et al. | |
| 2016/0348024 | A1 * | 12/2016 | Kashani-Shirazi | C10M 107/34 |
| 2017/0015931 | A1 * | 1/2017 | Watts | F16H 45/02 |
| 2018/0201860 | A1 * | 7/2018 | Ransom | C10M 159/20 |
| 2018/0258364 | A1 * | 9/2018 | Hartley | C10M 145/02 |
| 2019/0322958 | A1 * | 10/2019 | DeSantis | C10M 133/16 |
| 2019/0352577 | A1 * | 11/2019 | Marcella | C10M 169/044 |
| 2020/0165537 | A1 * | 5/2020 | Deckman | C10M 169/04 |
| 2020/0377817 | A1 | 12/2020 | Sampler et al. | |
| 2021/0179965 | A1 * | 6/2021 | Nga | C10M 169/047 |
| 2021/0189282 | A1 | 6/2021 | Wang et al. | |

FOREIGN PATENT DOCUMENTS

EP 2746372 B1 9/2020

OTHER PUBLICATIONS

The International Search Report and the Written Opinion of the International Searching Authority dated Aug. 20, 2021.

* cited by examiner

*Primary Examiner* — Ellen M McAvoy

(74) *Attorney, Agent, or Firm* — Vorys, Sater, Seymour and Pease LLP

(57) ABSTRACT

Provided is an engine oil lubricant composition with improved fuel efficiency and engine wear protection. The lubricant composition may include a major amount of an oil basestock from any one or more Group I, Group II, Group III, Group IV or Group V base oils. The resulting engine oil lubricant composition may have a kinematic viscosity at 100° C. of 6 cSt or less, and a corrosion protection of at least 90, as measured according the ASTM D6557 Ball Rust Test. The resulting engine oil lubricant composition may also have a kinematic viscosity at 100° C. of 6 cSt or less, an HTHS (ASTM D4683) of less than or equal to 2.2 cP at 150° C. and a FZG failure load stage of at least 6, as measured by the FZG A10/16.6R/130 test procedure.

12 Claims, No Drawings

ENGINE OIL LUBRICANT COMPOSITIONS AND METHODS FOR MAKING SAME WITH SUPERIOR ENGINE WEAR PROTECTION AND CORROSION PROTECTION

CROSS-REFERENCE TO RELATED APPLICATIONS

This application claims the benefit of U.S. Provisional Application No. 63/049,742, filed on 9 Jul. 2020, the entire contents of which are incorporated herein by reference.

FIELD OF THE INVENTION

Embodiments of the present invention generally relate to low viscosity engine oil lubricant compositions and methods for making same. Such compostions are useful for gasoline and diesel engines and provide a combination of excellent engine wear protection, corrosion protection and fuel efficiency.

DESCRIPTION OF THE RELATED ART

A major challenge in engine oil formulation is simultaneously achieving engine wear protection while also maintaining fuel economy performance. Fuel efficiency requirements for passenger vehicles are becoming increasingly more stringent. New legislation in the United States and European Union within the past few years has set fuel economy and carbon emissions targets not readily achievable with today's vehicle and lubricant technology. Due to these more stringent governmental regulations for vehicle fuel consumption and carbon emissions, use of low viscosity engine oils to meet these regulatory standards is becoming more prevalent.

To meet future carbon dioxide ($CO_2$) emission requirements, engine oil formulations often contain organic friction modifiers to help reduce friction and optimize engine efficiency. A major challenge in engine oil formulations containing organic friction modifiers, however, is the high surface activity which can lead to high corrosion.

Another major challenge in engine oil formulations due to the increased use of low viscosity engine oils is engine wear control. Lubricants need to provide a substantial level of durability performance at the same time as wear protection to engine parts due to the formation of thinner lubricant films during engine operation.

High temperature high-shear (HTHS) viscosity is the measure of a lubricant's viscosity under severe engine conditions. Under high temperatures and high stress conditions viscosity index improver degradation can occur. As this happens, the viscosity of the oil decreases which may lead to increased engine wear. HTHS is measured using ASTM D4683, which is incorporated herein by reference. Present day lubricant oils with a high temperature high-shear (HTHS) viscosity of less than 2.9 cP at 150° C. would not be expected to be able to provide acceptable passenger vehicle diesel engine wear and durability performance.

There remains a need for an engine oil lubricant that effectively improves fuel economy while also providing superior engine antiwear performance and anti-corrosion protection.

SUMMARY

Provided is an engine oil lubricant composition with superior engine wear protection. The lubricant composition may include a major amount of an oil basestock from any one or more Group I, Group II, Group III, Group IV or Group V base oils. The resulting engine oil lubricant composition may have a kinematic viscosity at 100° C. of 6 cSt or less, and a corrosion protection of at least 90, as measured according the ASTM D6557 Ball Rust Test. The resulting engine oil lubricant composition may also have a kinematic viscosity at 100° C. of 6 cSt or less, an HTHS (ASTM D4683) of less than or equal to 2.2 cP at 150° C. and a FZG failure load stage of at least 6, as measured by the FZG A10/16.6R/130 test procedure.

In certain embodiments, the lubricant composition further includes about 0.1 wt % to about 5.0 wt % of a polymeric ethylene oxide friction modifier, and about 0.1 wt % to about 8.0 wt % of at least one viscosity modifier, where the weight percents are based on the total weight of the engine oil lubricant composition.

In certain embodiments, the lubricant composition further includes about 0.1 wt % to about 5.0 wt % of a mixed glyceride friction modifier and about 0.1 wt % to about 8 wt % of at least one viscosity modifier, where the weight percents are based on the total weight of the engine oil lubricant composition.

DETAILED DESCRIPTION

A detailed description will now be provided. Each of the appended claims defines a separate invention, which for infringement purposes is recognized as including equivalents to the various elements or limitations specified in the claims. Depending on the context, all references to the "invention" may in some cases refer to certain specific embodiments only. In other cases, it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this disclosure is combined with publicly available information and technology.

Additionally, certain terms are used throughout the following description and claims to refer to particular components. As one skilled in the art will appreciate, various entities can refer to the same component by different names, and as such, the naming convention for the elements described herein is not intended to limit the scope of the invention, unless otherwise specifically defined herein. Further, the naming convention used herein is not intended to distinguish between components that differ in name but not function. Furthermore, in the following discussion and in the claims, the terms "including" and "comprising" are used in an open-ended fashion, and thus should be interpreted to mean "including, but not limited to."

The term "or" is intended to encompass both exclusive and inclusive cases, i.e., "A or B" is intended to be synonymous with "at least one of A and B," unless otherwise expressly specified herein.

The indefinite articles "a" and "an" refer to both singular forms (i.e., "one") and plural referents (i.e., one or more) unless the context clearly dictates otherwise.

The phrase "consisting essentially of" means that the described/claimed composition does not include any other components that will materially alter its properties by any more than 5% of that property, and in any case, does not include any other component to a level greater than 3 wt %.

It has now been found that an engine oil lubricant composition comprising a major amount of an oil basestock, an effective amount of at least one viscosity modifier ("VM") and at least one friction modifier provides a combination of improved fuel efficiency and engine wear protection. It has also now been found that an engine oil lubricant composition comprising a major amount of an oil basestock, an effective amount of at least one viscosity modifier ("VM") and at least one friction modifier provides a combination of improved fuel efficiency and engine corrosion protection.

An improved engine oil lubricant composition has also been found that can provide increased scuffing wear protection. Auto-builders are broadly deploying fully variable valve lift systems to improve engine efficiency and power output. Some systems are equipped with worm gear shafts that produce an adjustable valve stroke to control the air volume supplied to the engine. Scuffing wear issues have been observed on those worm gears caused by the high contact pressure during operation. Embodiments provided herein further relate to an improved engine oil lubricant composition that has been found to provide an unexpected increase in scuffing wear protection to overcome the foregoing scuffing wear issues.

Usually engine oil formulations are not designed to provide scuffing wear protection. Scuffing or adhesive wear is a more severe type of wear mechanism where metal to metal contact can result in bonding or welding between the metal surface contacts. However, when certain oil components are rebalanced or added to the formulation, scuffing wear protection may be significantly improved. Of note, the chemistries found to be effective were sulfur free which is needed so that catalytic converter life is not compromised.

The engine oil lubricant compositions are non-Newtonian in terms of viscometric properties. A non-Newtonian fluid is a fluid in which the viscous stresses arising from its flow, at every point, are not linearly proportional to the local strain rate. For a non-Newtonian fluid, the viscosity (the measure of a fluid's ability to resist gradual deformation by shear or tensile stresses) is dependent on shear rate or shear rate history. By contrast, a Newtonian fluid is a fluid that in which the viscous stresses arising from its flow, at every point, are linearly proportional to the local strain rate, that is the rate of change of its deformation over time.

The inventive engine oil lubricant compositions are of relatively low viscosity as measured by kinematic viscosity at 100° C. (ASTM D445, KV100) in having a KV100 of less than or equal to 10 cSt, or less than or equal to 8 cSt, or less than or equal to 6 cSt, or less than or equal to 4 cSt, or less than or equal to 2 cSt. The engine oil lubricant composition also has an HTHS (ASTM D4683) of less than or equal to 2.2 cP at 150° C., or less than or equal to 2.0 cP at 150° C., or less than or equal to 1.8 cP at 150° C., or less than equal to 1.7 cP at 150° C. The HTHS at 150° C. is a measure of fuel efficiency with lower HTHS values yielding improved fuel economy in direct injection engines, gasoline engines, and diesel engines.

In one exemplary non-limiting form of the engine oil lubricant composition, the composition includes a major amount of a base oil comprising a Group IV basestock, a Group II basestock and an optional Group V basestock, from 0.1 to 8.0 wt % of at least one viscosity modifier and from 0.1 to 5.0 wt % of at least one friction modifier, based on the total weight of the lubricant composition. The engine oil lubricant composition may have a kinematic viscosity at 100° C. of less than or equal to 10 cSt, and an HTHS viscosity of less than or equal to 2.2 cP at 150° C.

The Group IV basestock may be included in the engine oil lubricant composition at from 55 to 100 wt %, or 60 to 95 wt %, or from 65 to 90 wt % in terms of the total weight of the base oil. The Group II basestock may be included in the engine oil lubricant composition at from 0 to 25 wt %, or 5 to 20 wt %, or from 10 to 15 wt % in terms of the total weight of the base oil. The Group II (GTL) basestock has a kinematic viscosity at 100° C. of from 1 to 3.7 cSt.

The optional Group V basestock may be any Group V basestock. Non-limiting exemplary Group V basestocks include alkylated naphthalene basestocks, ester basestocks, aliphatic ether basestocks, aryl ether basestocks, ionic liquid basestocks, and combinations thereof. The optional Group V basestock may be included in the engine oil lubricant composition at from 0 to 30 wt %, 0 to 10 wt % or from 0 to 5 wt % in terms of the total weight of the base oil. The Group V basestock may have a kinematic viscosity at 100° C. of from 1 to 8 cSt, or 2 to 6 cSt, or 3 to 5 cSt.

Also provided herein is a method for improving fuel efficiency and engine wear protection in an engine lubricated with a lubricating oil by using an engine oil lubricant composition described herein as the lubricating oil. In a preferred embodiment, the engine oil lubricant composition includes a major amount of a base oil comprising a Group IV basestock and a Group II basestock and an optional Group V basestock, from 0.1 to 8.0 wt % of at least one viscosity modifier and from 0.1 to 5.0 wt % of at least one friction modifier, based on the total weight of the lubricant composition. The engine oil lubricant composition may be used to lubricate internal combustion engines, including, but not limited to, direct injection engines, gasoline engines, and diesel engines.

Also provided herein is a method of making an engine oil lubricant composition. The engine oil lubricant composition may be made by providing a base oil comprising a Group IV basestock, a Group II basestock, and an optional Group V basestock, at least one viscosity modifier and at least one friction modifier, and blending from 70 to 90 wt % of the base oil with from 0.1 to 8.0 wt % of the at least one viscosity modifier and from 0.1 to 5.0 wt % of the at least one friction modifier, based on the total weight of the lubricant composition.

The engine oil lubricant compositions, methods of using the lubricant compositions and methods of making the lubricant composition yield an engine oil having a kinematic viscosity at 100° C. of less than or equal to 10 cSt, an HTHS (ASTM D4683) of less than or equal to 2.2 cP at 150° C. The engine oil lubricant compositions are particularly suitable as 0W-4, 0W-8, 0W-12 and 0W-16 viscosity grade engine oils.

Base Oils

Lubricating base oils that are useful in the present disclosure are both natural oils, and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used.

Groups I, II, III, IV and V are broad categories of base oil stocks developed and defined by the American Petroleum Institute (API Publication 1509; www.API.org) to create guidelines for lubricant base oils. Group I basestocks generally have a viscosity index of between about 80 to 120 and contain greater than about 0.03% sulfur and/or less than about 90% saturates. Group II basestocks generally have a viscosity index of between about 80 to 120, and contain less than or equal to about 0.03% sulfur and greater than or equal to about 90% saturates. Group III stocks generally have a viscosity index greater than about 120 and contain less than or equal to about 0.03% sulfur and greater than about 90% saturates. Group IV includes polyalphaolefins (PAO). Group V basestock includes basestocks not included in Groups I-IV.

Non-limiting exemplary Group V basestocks include alkylated naphthalene basestock, ester basestock, aliphatic ether basestock, aryl ether basestock, ionic liquid basestock, and combinations thereof.

The table below summarizes properties of each of these five groups.

Base Oil Properties

| | Saturates | Sulfur | Viscosity Index |
|---|---|---|---|
| Group I | <90 &/or | >0.03% & | ≥80 & <120 |
| Group II | ≥90 & | ≤0.03% & | ≥80 & <120 |
| Group III | ≥90 & | ≤0.03% & | ≥120 |
| Group IV | Includes polyalphaolefins (PAO) | | |
| Group V | All other base oil stocks not included in Groups I, II, III, or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked basestocks, including synthetic oils such as polyalphaolefins, alkyl aromatics and synthetic esters are also well known basestock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil basestocks are commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from about 250 to about 3,000, although PAO's may be made in viscosities up to about 100 cSt (100° C.). The PAOs are typically comprised of relatively low molecular weight hydrogenated polymers or oligomers of alphaolefins which include, but are not limited to, $C_2$ to about $C_{32}$ alphaolefins with the $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity basestocks of acceptably low volatility. Depending on the viscosity grade and the starting oligomer, the PAOs may be predominantly trimers and tetramers of the starting olefins, with minor amounts of the higher oligomers, having a viscosity range of 1.5 to 12 cSt.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or U.S. Pat. No. 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

The hydrocarbyl aromatics can be used as base oil or base oil component and can be any hydrocarbyl molecule that contains at least about 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from about $C_6$ up to about $C_{60}$ with a range of about $C_8$ to about $C_{20}$ often being preferred. A mixture of hydrocarbyl groups is often preferred, and up to about three such substituents may be present. The hydrocarbyl group can optionally contain sulfur, oxygen, and/or nitrogen containing substituents. The aromatic group can also be derived from natural (petroleum) sources, provided at least about 5% of the molecule is comprised of an above-type aromatic moiety. Viscosities at 100° C. of approximately 3 cSt to about 50 cSt are preferred, with viscosities of approximately 3.4 cSt to about 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be about 2% to about 25%, preferably about 4% to about 20%, and more preferably about 4% to about 15%, depending on the application.

Esters comprise a useful basestock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least about 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms. These esters are widely available commercially, for example, the Mobil P-41 and P-51 esters of ExxonMobil Chemical Company).

Other useful fluids of lubricating viscosity include non-conventional or unconventional basestocks that have been processed, preferably catalytically, or synthesized to provide high performance lubrication characteristics.

Non-conventional or unconventional basestocks/base oils include one or more of a mixture of basestock(s) derived from one or more Gas-to-Liquids (GTL) materials, as well as isomerate/isodewaxate basestock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such basestocks.

The base oil constitutes the major component of the engine oil lubricant composition of the present invention and typically is present in an amount ranging from about 50 to about 99 wt %, e.g., from 70 to 90 wt % or from about 85 to about 95 wt %, based on the total weight of the composition. The base oil may be selected from any of the synthetic or natural oils typically used as crankcase lubricating oils for spark-ignited and compression-ignited engines. The base oil conveniently has a kinematic viscosity, according to ASTM standards, of about 1.0 cSt to about 16.0 cSt (or $mm^2/s$) at 100° C., preferably of about 1.0 cSt to about 12.0 cSt (or $mm^2/s$) at 100° C., more preferably of about 2.0 cSt to about 8.0 cSt (or $mm^2/s$) at 100° C. and even more preferably of about 2.0 cSt to about 4.0 cSt (or $mm^2/s$) at 100° C. Mixtures of synthetic and natural base oils may be used if desired. As used herein, the basestock name is associated with the D445 KV100 viscosity of the basestock. For instance, PAO 4 has a D445 100C viscosity of 4 cSt; GTL 3 has a D445 100C viscosity of 3 cSt.

The engine oil lubricant composition of the present invention can have an HTHS viscosity of less than or equal to 2.2 cP at 150° C., or less than or equal to 2.1 cP at 150° C., or less than or equal to 2.0 cP at 150° C., or less than or equal to 1.9 cP at 150° C., and preferably about 2.0 cP at 150° C.

Viscosity Modifiers (VM)

Viscosity modifiers are also known as VI improvers, viscosity index improvers and viscosity improvers. Suitable viscosity modifiers provide lubricants with high temperature and low temperature operability. Suitable viscosity modifiers also impart shear stability at elevated temperatures and acceptable viscosity at low temperatures. Suitable viscosity modifiers may be or may include one or more linear or star-shaped polymers and/or copolymers of methacrylate, butadiene, olefins, isoprene or alkylated styrenes, polyisobutylene, polymethacrylate, ethylene-propylene, hydrogenated block copolymer of styrene and isoprene, polyacrylates, styrene-isoprene block copolymer, styrene-butadiene copolymer, ethylene-propylene copolymer, hydrogenated star polyisoprene, and combinations thereof.

As used herein, the term "polymer" refers to any two or more of the same or different repeating units/mer units or units. The term "homopolymer" refers to a polymer having units that are the same. The term "copolymer" refers to a polymer having two or more units that are different from each other, and includes terpolymers and the like. The term "terpolymer" refers to a polymer having three units that are different from each other. The term "different" refers to units indicates that the units differ from each other by at least one atom or are different isomerically. Likewise, the definition of polymer, as used herein, includes homopolymers, copolymers, and the like. Furthermore, the term "styrenic block copolymer" refers to any copolymer that includes units of styrene and a mid-block.

Suitable olefin copolymers, for example, are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC® 5850B"; and from The Lubrizol Corporation under the trade designation "Lubrizol® 7067C". Suitable polyisoprene polymers, for example, are commercially available from Infineum International Limited, e.g. under the trade designation "SV200". Suitable diene-styrene copolymers, for example, are commercially available from Infineum International Limited, e.g. under the trade designation "SV 260".

One particularly suitable viscosity modifier is polyisobutylene. Another particularly suitable viscosity modifier is polymethacrylate, which can also serve as pour point depressant. Other particularly suitable viscosity modifiers include copolymers of ethylene and propylene, hydrogenated block copolymers of styrene and isoprene, and polyacrylates. Specific examples include styrene-isoprene and styrene-butadiene based polymers of 50,000 to 200,000 molecular weight.

Suitable viscosity modifiers may further include high molecular weight hydrocarbons, polyesters and dispersants that function as both a viscosity modifier and a dispersant. Typical molecular weights of these polymers may range between about 10,000 and about 2,000,000, more typically about 20,000 and about 1,500,000, and even more typically between about 50,000 and about 1,200,000.

The at least one viscosity modifier may be included in the engine oil lubricant composition at a concentration of from 0.1 to 5 wt %, or 0.1 to 8 wt %, or 0.1 to 14 wt %, or 0.5 to 10 wt %, or 0.01 to 2 wt %, or 1.0 to 7.5 wt %, or 1.5 to 5 wt %. The at least one viscosity modifier may also be included in the engine oil lubricant composition at a concentration ranging from a low of about about 0.1 wt %, about 0.3 wt %, or about 0.5 wt % to a high of about 5 wt %, about 8 wt %, or about 16 wt %. The at least one viscosity modifier concentration may also range from a low of about about 0.1 wt %, about 0.5 wt %, or about 1.0 wt % to a high of about 8 wt %, about 12 wt %, or about 14 wt %. The foregoing viscosity modifier concentrations are based on a polymer concentrate basis in terms of the total weight of the lubricating composition.

Friction Modifier

A friction modifier is any material or two or more materials that can alter the coefficient of friction of a surface lubricated by a lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present invention if desired. Friction modifiers that lower the coefficient of friction are particularly advantageous in combination with the base oils and lube compositions of this invention. Friction modifiers may include metal-containing compounds or materials as well as ashless compounds or materials, or mixtures thereof. Metal-containing friction modifiers may include metal salts or metal-ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Such suitable ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination.

Ashless friction modifiers can also be used. Suitable ashless friction modifiers may include hydroxyl-containing hydrocarbyl base oils, glycerides, partial glycerides, glyceride derivatives, fatty organic acids, fatty amines, and sulfurized fatty acids. Suitable ashless friction modifiers may also include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers. In some instances, friction modifiers containing ethylene-oxide segments are effective.

Ashless friction modifiers may be or may include polymeric and/or non-polymeric molecules. A suitable polymeric friction modifier may have a weight average molecular weight (Mw) of 3,000 or more; 4,000 or more; 5,000 or more; 6,000 or more; 7,000 or more; 8,000 or more; 9,000 or more; 10,000 or more; 15,000 or more; 20,000 or more; 30,000 or more; 40,000 or more; or 45,000 or more. The Mw of suitable polymeric friction modifiers may also range from a low of about 3,000, about 4,000, or about 5,000 to a high of about 10,000; about 30,000, or about 50,000. The Mw of suitable polymeric friction modifiers may also range from about 3,000 to 15,000; about 4,000 to about 12,000; about 3,000 to about 9,000; about 3,000 to about 7,000. The Mw of suitable polymeric friction modifiers may also be about 3,000, about 4,000, about 5,000, about 6,000, about 7,000, about 8,000, or about 9,000. A particularly suitable polymeric friction modifier is or includes ethylene oxide (EtO). A suitable ethylene oxide friction modifier is a poly-hydroxylcarboxylic acid ester of polyalkylene oxide modified polyols, such as those described in US Publication No. 2016/0264907A1.

A suitable non-polymeric friction modifier may be or may include a mixed glyceride ester of mostly C14, C16, and C18 molecules. Each C14, C16, and C18 molecule may be linear, branched or cyclic. A majority of the C14, C16, and C18 molecules are linear and are completely saturated. The mixed glyceride ester may be a mix of monoglycerides, diglycerides and triglycerides including the mixed glyceride ester and methods for making the same as shown and described in US Publication No. 2016/0264907A1.

One or more friction modifiers may be included in the engine oil lubricant composition at a concentration of from 0.1 to 5 wt %, or 0.1 to 6 wt %, or 0.1 to 8 wt %, or 0.5 to 10 wt %, or 0.01 to 2 wt %, or 1.0 to 7.5 wt %, or 1.5 to 5 wt %. The at least one friction modifier may also be included in the engine oil lubricant composition at a concentration ranging from a low of about about 0.1 wt %, about 0.3 wt %, or about 0.5 wt % to a high of about 5 wt %, about 10 wt %, or about 16 wt %. The at least one friction modifier concentration may also range from a low of about about 0.1 wt %, about 0.5 wt %, or about 1.0 wt % to a high of about 5 wt %, about 8 wt %, or about 10 wt %. The foregoing friction modifier concentrations are based on the total weight of the lubricating composition.

Other Additives

The engine oil lubricant composition may also include one or more other additives typical for engine oils. These other additives may include any one or more anti-wear additives, dispersants, detergents, antioxidants, pour point depressanst, corrosion inhibitors, anti-rust additives, metal deactivators, seal compatibility additives, and anti-foam agents. These other additives may be provided to the lubricant composition in the form of an additive package. The additive packages may be incorporated into the engine lubricant compositions at loadings of about 9 wt % to about 15 wt %, or about 10 to about 14.5 wt %, or about 11 to about 14 wt %, based on the total weight of the composition. The additive packages may also be incorporated into the engine lubricant compositions at loadings ranging from a low of about 5 wt %, about 7 wt %, about 9 wt %, or about 10 wt % to a high of about 11 wt %, about 14 wt %, about 14.5 wt %, or about 15 wt %, based on the total weight of the composition.

Antiwear

While there are many different types of antiwear additives, for several decades the principal antiwear additive for internal combustion engine crankcase oils is a metal alkylthiophosphate and more particularly a metal dialkyldithiophosphate in which the metal constituent is zinc, or zinc dialkyldithiophosphate (ZDDP). ZDDP can be primary, secondary or mixtures thereof. ZDDP compounds generally are of the formula $Zn[SP(S)(OR^1)(OR^2)]_2$ where $R^1$ and $R^2$ are $C_1$-$C_{18}$ alkyl groups, preferably $C_2$-$C_{12}$ alkyl groups. These alkyl groups may be straight chain or branched. The ZDDP is typically used in amounts of from about 0.4 to 1.4 wt % of the total lubricant oil composition, although more or less can often be used advantageously. Preferably, the ZDDP is a secondary ZDDP and present in an amount of from about 0.6 to 1.0 wt %, or from 0.6 to 0.91 wt % of the total lubricant composition.

Preferable zinc dithiophosphates which are commercially available include secondary zinc dithiophosphates such as those available from for example, The Lubrizol Corporation under the trade designations "LZ 677A", "LZ 1095" and "LZ 1371", from for example Chevron Oronite under the trade designation "OLOA 262" and from for example Afton Chemical under the trade designation "HITEC 7169".

Dispersants

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So-called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. Patents describing such dispersants are U.S. Pat. Nos. 3,172,892; 3,215,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Pat. No. 1,094,044.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the alkenyl succinic anhydrides used in the preceding paragraphs will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this invention can be prepared from high molecular weight alkyl-substituted hydroxyaromatics or HN(R)2 group-containing reactants.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of about 0.1 to 20 wt %, preferably about 0.5 to 8 wt %.

Detergents

Detergents are commonly used in lubricating compositions. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is desirable for at least some detergent to be overbased. Overbased detergents help neutralize acidic impurities produced by the combustion process and become entrapped in the oil. Typically, the overbased material has a ratio of metallic ion to anionic portion of the detergent of about 1.05:1 to 50:1 on an equivalent basis. More preferably, the ratio is from about 4:1 to about 25:1. The resulting detergent is an overbased detergent that will typically have a TBN of about 150 or higher, often about 250 to 450 or more. Preferably, the overbasing cation is sodium, calcium, or magnesium. A mixture of detergents of differing TBN can be used in the present invention.

Preferred detergents include the alkali or alkaline earth metal salts of sulfonates, phenates, carboxylates, phosphates, and salicylates.

Sulfonates may be prepared from sulfonic acids that are typically obtained by sulfonation of alkyl substituted aromatic hydrocarbons. Hydrocarbon examples include those obtained by alkylating benzene, toluene, xylene, naphthalene, biphenyl and their halogenated derivatives (chlorobenzene, chlorotoluene, and chloronaphthalene, for example). The alkylating agents typically have about 3 to 70 carbon atoms. The alkaryl sulfonates typically contain about 9 to about 80 carbon or more carbon atoms, more typically from about 16 to 60 carbon atoms.

Klamann in "Lubricants and Related Products", op cit discloses a number of overbased metal salts of various sulfonic acids which are useful as detergents and dispersants in lubricants. The book entitled "Lubricant Additives", C. V. Smallheer and R. K. Smith, published by the Lezius-Hiles Co. of Cleveland, Ohio (1967), similarly discloses a number of overbased sulfonates that are useful as dispersants/detergents.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

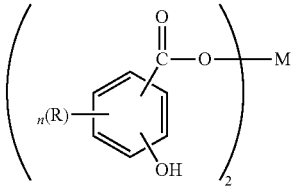

where R is a hydrogen atom or an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Alkaline earth metal phosphates may also be used as detergents.

Detergents may be simple detergents or what is known as hybrid or complex detergents. The latter detergents can provide the properties of two detergents without the need to blend separate materials. See U.S. Pat. No. 6,034,039, for example.

Preferred detergents may include calcium phenates, calcium sulfonates, calcium salicylates, magnesium phenates, magnesium sulfonates, magnesium salicylates and other related components (including borated detergents). Typically, the total detergent concentration is about 0.01 to about 6.0 wt %, or 0.01 to 4 wt %, or 0.01 to 3 wt %, or 0.01 to 2.2 wt %, or 0.01 to 1.5 wt % and preferably, about 0.1 to 3.5 wt %.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Useful antioxidants may include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_{6+}$ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant invention. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic mono-amines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; t-octylphenyl-alpha-naphthylamine; phenyl-alphanaphthylamine; and p-octylphenyl-alpha-naphthylamine. Sulfurized alkyl phenols and alkali or alkaline earth metal salts thereof may also be useful antioxidants.

Preferred antioxidants include hindered phenols, arylamines. These antioxidants may be used individually by type or in combination with one another.

Antioxidants may be used in an amount of about 0.01 to 5 wt %, preferably about 0.01 to 1.5 wt %, more preferably zero to less than 1.5 wt %, most preferably zero, based on the total weight of the engine oil lubricant.

Pour Point Depressants

Conventional pour point depressants (also known as lube oil flow improvers) may be added to the compositions of the present invention if desired. These pour point depressant may be added to lubricating compositions of the present invention to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof. Such additives may be used in an amount of about 0.01 to 5 wt %, preferably about 0.01 to 1.5 wt %, based on the total weight of the engine oil lubricant.

Corrosion Inhibitor

One or more corrosion inhibitors may be added to the lubricating oil compositions. Corrosion inhibitors are additives that protect lubricated metal surfaces against chemical attack by water or other contaminants. Corrosion inhibitors may also be used to reduce the degradation of metallic parts that are in contact with the lubricating oil composition. As used herein, corrosion inhibitors include anti-rust additives, metal deactivators, and metal passivators.

One type of corrosion inhibitor is a polar compound that wets the metal surface preferentially, protecting it with a film of oil. Another type of corrosion inhibitor absorbs water by incorporating it in a water-in-oil emulsion so that only oil touches the metal surface. Yet another type of corrosion inhibitor chemically adheres to the metal to produce a non-reactive surface. Suitable corrosion inhibitors include zinc dithiophosphates, metal phenolates, basic metal sulfonates, fatty acids and amines. Other suitable corrosion inhibitors include, for example, aryl thiazines, alkyl substituted dimercaptothiodiazoles, alkyl substituted dimercaptothiadiazoles, thiazoles, triazoles, non-ionic polyoxyalkylene polyols and esters thereof, polyoxyalkylene phenols, anionic alkyl sulfonic acids, and the like, and mixtures thereof.

Illustrative corrosion inhibitors may include, for example, (short-chain) alkenyl succinic acids, partial esters thereof and nitrogen-containing derivatives thereof; and petroleum sulfonates, synthetic sulfonates, synthetic alkarylsulfonates, such as metal alkylbenzene sulfonates, and metal dinonylnaphthalene sulfonates. Corrosion inhibitors also include, for example, monocarboxylic acids which have from 8 to 30 carbon atoms, alkyl or alkenyl succinates or partial esters thereof, hydroxy-fatty acids which have from 12 to 30 carbon atoms and derivatives thereof, sarcosines which have from 8 to 24 carbon atoms and derivatives thereof, amino acids and derivatives thereof, naphthenic acid and derivatives thereof, lanolin fatty acid, mercapto-fatty acids and paraffin oxides.

Particularly preferred corrosion inhibitors include, for example, monocarboxylic acids ($C_8$-$C_{30}$), caprylic acid, pelargonic acid, decanoic acid, undecanoic acid, lauric acid, myristic acid, palmitic acid, stearic acid, arachic acid, behenic acid, cerotic acid, montanic acid, melissic acid, oleic acid, docosanic acid, erucic acid, eicosenic acid, beef tallow fatty acid, soy bean fatty acid, coconut oil fatty acid, linolic acid, linoleic acid, tall oil fatty acid, 12-hydroxystearic acid, laurylsarcosinic acid, myritsylsarcosinic acid, palmitylsarcosinic acid, stearylsarcosinic acid, oleylsarcosinic acid, alkylated ($C_8$-$C_{20}$) phenoxyacetic acids, lanolin fatty acid and $C_8$-$C_{24}$ mercapto-fatty acids.

Examples of polybasic carboxylic acids which function as corrosion inhibitors include alkenyl ($C_{10}$-$C_{100}$) succinic acids and ester derivatives thereof, dimer acid, N-acyl-N-alkyloxyalkyl aspartic acid esters (U.S. Pat. No. 5,275,749). Examples of the alkylamines which function as corrosion inhibitors or as reaction products with the above carboxylates to give amides and the like are represented by primary amines such as laurylamine, coconut-amine, n-tridecylamine, myristylamine, n-pentadecylamine, palmitylamine, n-heptadecylamine, stearylamine, n-nonadecylamine, n-eicosylamine, n-heneicosylamine, n-docosylamine, n-tricosylamine, n-pentacosylamine, oleylamine, beef tallow-amine, hydrogenated beef tallow-amine and soy bean-amine. Examples of the secondary amines include dilaurylamine, di-coconut-amine, di-n-tri decyl amine, dimyristylamine, di-n-pentadecylamine, dipalmitylamine, di-n-pentadecylamine, distearylamine, di-n-nonadecylamine, di-n-eicosylamine, di-n-heneicosylamine, di-n-docosylamine, di-n-tricosylamine, di-n-pentacosyl-amine, dioleylamine, di-beef tallow-amine, di-hydrogenated beef tallow-amine and di-soy bean-amine. Examples of the aforementioned alkylenediamines, alkylated alkylenediamines, and N-alkylpolyalkyenediamines include: ethylenediamines such as laurylethylenediamine, coconut ethylenediamine, n-tridecylethylenediamine-, myri stylethylenediamine, n-pentadecylethylenediamine, palmityl ethyl enediamine, n-heptadecylethylenediamine, stearylethylenediamine, n-nonadecylethylenediamine, n-eicosylethylenediamine, n-heneicosyl ethylenediamine, n-docosylethylendiamine, n-tricosylethylenediamine, n-pentacosylethylenediamine, oleylethylenediamine, beef tallow-ethylenediamine, hydrogenated beef tallow-ethylenediamine and soy bean-ethylenediamine; propylenediamines such as laurylpropylenediamine, coconut propylenediamine, n-tridecylpropylenediamine, myri stylpropylenediamine, n-pentadecylpropyl enediamine, palmitylpropyl enediamine, n-heptadecylpropylenedi amine, stearylpropylenedi amine, n-nonadecylpropylenediamine, n-eicosylpropylenediamine, n-heneicosylpropylenediamine, n-docosylpropylendiamine, n-tricosylpropylenediamine, n-pentacosylpropylenediamine, diethylene triamine (DETA) or triethylene tetramine (TETA), oleylpropylenediamine, beef tallow-propylenediamine, hydrogenated beef tallow-propylenediamine and soy bean-propylenediamine; butylenediamines such as laurylbutyl enediamine, coconut butylenediamine, n-tridecylbutylenediamine-myristylbutylenediamine, n-pentadecylbutylenediamine, stearylbutylenediamine, n-eicosylbutylenediamine, n-heneicosylbutylenedia-mine, n-docosylbutylendiamine, n-tricosylbutylenediamine, n-pentacosylbutylenediamine, oleylbutylenediamine, beef tallow-butylenediamine, hydrogenated beef tallow-butylenediamine and soy bean butylenediamine; and pentylenediamines such as laurylpentylenediamine, coconut pentylenediamine, myristylpentylenediamine, palmitylpentylenediamine, stearylpentyl enediamine, oleylpentylenediamine, beef tallow-pentylenediamine, hydrogenated beef tallow-pentylenediamine and soy bean pentylenediamine.

Other illustrative corrosion inhibitors include 2,5-dimercapto-1,3,4-thiadiazoles and derivatives thereof, mercaptobenzothiazoles, alkyltriazoles and benzotriazoles. Examples of dibasic acids useful as corrosion inhibitors, which are used in the present disclosure, are sebacic acid, adipic acid, azelaic acid, dodecanedioic acid, 3-methyladipic acid, 3-nitrophthalic acid, 1,10-decanedicarboxylic acid, and fumaric acid. The corrosion inhibitors may be a straight or branch-chained, saturated or unsaturated monocarboxylic acid or ester thereof which are optionally sulfurized in an amount up to 35 wt %. Preferably the acid is a $C_4$ to $C_{22}$ straight chain unsaturated monocarboxylic acid. The preferred concentration of this additive is from 0.001 wt % to 0.35 wt % of the total lubricant composition. The preferred monocarboxylic acid is sulfurized oleic acid. Alternatively, other suitable materials include oleic acid itself, valeric acid and erucic acid. An illustrative corrosion inhibitor includes a triazole as previously defined. The triazole should be used at a concentration from 0.005 wt % to 0.25 wt % of the total composition. The preferred triazole is tolylotriazole which is suitably included in the compositions of the disclosure. Also suitably included in compositions are triazoles, thiazoles and certain diamine compounds which are useful as metal deactivators or metal passivators. Examples include triazole, benzotriazole and substituted benzotriazoles such as alkyl substituted derivatives. The alkyl substituent generally contains up to 15 carbon atoms, preferably up to 8 carbon atoms. The triazoles optionally contain other substituents on the aromatic ring such as halogens, nitro, amino, mercapto, etc. Examples of suitable compounds are benzotriazole and the tolyltriazoles, ethylbenzotriazoles, hexylb enzotriazoles, octylbenzotriazoles, chlorobenzotriazoles and nitrobenzotriazoles. Benzotriazole and tolyltriazole are particularly preferred. A straight or branched chain saturated or unsaturated monocarboxylic acid which is optionally sulfurized in an amount which is up to 35 wt %; or an ester of such an acid; and a triazole or alkyl derivatives thereof, or short chain alkyl of up to 5 carbon atoms; n is zero or an integer between 1 and 3 inclusive; and is hydrogen, morpholino, alkyl, amido, amino, hydroxy or alkyl or aryl substituted derivatives thereof; or a triazole selected from 1,2,4 triazole, 1,2,3 triazole, 5-anilo-1,2,3,4-thiatriazole, 3-amino-1,2,4 triazole, 1-H-benzotriazole-1-yl-methyli socyani de, methyl ene-bi s-benzotriazole and naphthotriazole.

Other illustrative corrosion inhibitors may include 2-mercaptobenzothiazole, dialkyl-2,5-dimercapto-1,3,4-thiadiazole; N,N'-disalicylideneethylenedi amine, N,N'-disalicylidenepropylenediamine, N-salicylideneethylamine, N,N'-di salicylideneethyldiamine; triethylenediamine, ethylenediaminetetraacetic acid; zinc dialkyldithiophosphates and dialkyl dithiocarbamates, and the like.

Other illustrative corrosion inhibitors may include a yellow metal passivator. The term "yellow metal" refers to a metallurgical grouping that includes, for example, brass and bronze alloys, aluminum bronze, phosphor bronze, copper, copper nickel alloys, and beryllium copper, and the like. Typical yellow metal passivators include, for example, benzotriazole, tolutriazole, tolyltriazole, mixtures of sodium tolutriazole and tolyltriazole, imidazole, benzimidazole, imidazoline, pyrimidine, and derivatives thereof, and combinations thereof. In one particular and non-limiting embodiment, a compound containing tolyltriazole is selected.

The one or more metal corrosion inhibitors may be present in amounts ranging from about 0.01 wt % to about 5.0 wt %, preferably about 0.01 wt % to about 3.0 wt %, and more preferably from about 0.01 wt % to about 1.5 wt %, based on the total weight of the engine oil lubricant composition.

Seal Compatibility Agents

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 wt %, preferably about 0.01 to 2 wt %, based on the total weight of the engine oil lubricant.

Anti-Foam

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 weight percent and often less than 0.1 wt %, based on the total weight of the engine oil lubricant composition.

When lubricating oil compositions contain any one or more of the additives discussed above, the additive(s) are blended into the composition in an amount sufficient for it to perform its intended function. Illustrative amounts of such additives that can be used in the engine oil lubricants described herein are shown in Table 1 below.

Note that many of the additives are shipped from the manufacturer and used with a certain amount of base oil diluent in the formulation. Accordingly, the weight amounts in Table 1, as well as other amounts mentioned in this specification, are directed to the amount of active ingredient (that is the non-diluent portion of the ingredient). The wt % indicated below are based on the total weight of the lubricating oil composition.

TABLE 1

Typical Amounts of Various Lubricant Oil Components

| Compound | Approximate wt % (Useful) | Approximate wt % (Preferred) |
|---|---|---|
| Detergent | 0.01-6 | 0.01-4 |
| Dispersant | 0.1-20 | 0.1-8 |
| Friction Modifier | 0.01-5 | 0.01-1.5 |
| Viscosity Modifier (solid polymer basis) | 0.1-8 | 0.1-6 |
| Antioxidant | 0.1-5 | 0.1-2.0 |
| Anti-wear Additive | 0.01-6 | 0.01-4 |
| Pour Point Depressant | 0.0-5 | 0.01-1.5 |
| Anti-foam Agent | 0.001-3 | 0.001-0.15 |
| Basestock or base oil | Balance | Balance |

The foregoing additives may be added independently or may be pre-combined in packages which can be obtained from suppliers of lubricant oil additives. Additive packages with a variety of ingredients, proportions and characteristics are available and selection of the appropriate package will take the requisite use of the ultimate composition into account. The additive package may be incorporated into the engine oil lubricant compositions at loadings of about 9 wt % to about 15 wt %, or about 10 wt % to about 14.5 wt %, or about 11 wt % to about 14 wt %, based on the total weight of the lubricant composition.

EXAMPLES

The foregoing discussion can be further described with reference to the following non-limiting examples.

Six lubricating engine oil compositions containing varying amounts of a polymeric ethylene oxide (EtO) friction modifier and varying amounts of a styrene-isoprene block copolymer viscosity modifier were tested and evaluated for viscosity and corrosion protection using the ASTM D6557 Ball Rust Test. To get a sufficient corrosion protection in this test, a final result of ≥90 is desirable. Table 2 reports the lubricant formulations for each example. The polymeric ethylene oxide friction modifier had a weight average moleculer weight (Mw) of 9,200. The styrene-isoprene star block copolymer ("SI block") was 27 wt % styrene and had a Mw of 989,000. This SI block compolymer was delivered as 6 wt % solid polymer in diluent.

The results below in Table 3 show the presence of the polymeric ethylene oxide friction modifier in concentrations of 0.25 wt % or less provided unexpected corrosion protection, as shown by the Ball Rust Test results.

TABLE 2

Lubricant oil composition in wt % for Examples A1 to A6.

| | A1 | A2 | A3 | A4 | A5 | A6 |
|---|---|---|---|---|---|---|
| PAO 3.6 Group IV basestock | 69.32 | 69.57 | 69.82 | 69.57 | 69.72 | 69.82 |
| GTL 3 Group II basestock | 12 | 12 | 12 | 12 | 12 | 12 |
| C8/C10 TMP ester Group V basestock | 2.4 | 2.4 | 2.4 | 2.4 | 2.4 | 2.4 |
| Other Additives | 10.3 | 10.3 | 10.3 | 10.3 | 10.3 | 10.3 |
| SI block viscosity modifier | 2 | 2 | 2 | 2.5 | 2.5 | 2.5 |

TABLE 2-continued

Lubricant oil composition in wt % for Examples A1 to A6.

| | A1 | A2 | A3 | A4 | A5 | A6 |
|---|---|---|---|---|---|---|
| 68 TBN Ca Salicylate Detergent | 1.65 | 1.65 | 1.65 | 1.65 | 1.65 | 1.65 |
| 400 TBN Mg Sulfonate Detergent | 0.2 | 0.2 | 0.2 | 0.2 | 0.2 | 0.2 |
| 205 TBN Ca Salicylate Detergent | 1.4 | 1.4 | 1.4 | 1.4 | 1.4 | 1.4 |
| Polymeric EtO friction modifier | 1 | 0.75 | 0.5 | 0.25 | 0.1 | 0 |

TABLE 3

Test results for Compositions A1 to A6

| | A1 | A2 | A3 | A4 | A5 | A6 |
|---|---|---|---|---|---|---|
| ASTM D6557, Ball Rust Test | 52 | 59 | 75 | 92 | 96 | 106 |
| Kinematic Viscosity at 100° C. | 5.80 | 5.74 | 5.65 | 5.66 | | 5.58 |
| HTHS, ASTM D4683 (cP @ 150° C.) | 2.04 | 2.02 | 2.00 | 2.01 | | |

Additional formulations were evaluated for scuffing using the FZG A10/16.6R/130 test method. The test severity was increased through the elevated test temperature of 130° C. To obtain an acceptable protection against scuffing, a failure load stage of 6 or higher is desired. Table 4 reports the lubricant oil formulations for each example. The SI block copolymer viscosity modifier was the same as that used for A1 to A6 above. The test results are shown below in Table 5. The results show that the use of the ethylene oxide friction modifier (Example B2) provided an unexpected performance increase in scuffing. The results also show the addition of a high viscosity PAO base oil (Example B3) provided a benefit in load-carrying capacity and an increase in wear protection was observed when tested according to ASTM D2783. In Examples B4 and B5 the non-polymeric friction modifier was a mixed glyceride ester (mono, di and tri) of mostly C14, C16, and C18, completely saturated. Example B1 was a comparative example having no polymeric or non-polymeric friction modifier.

TABLE 4

Lubricant Oil Compositiion for Comparative Ex. B1 and Examples B2 to B5.

| | Comp. B1 | B2 | B3 | B4 | B5 |
|---|---|---|---|---|---|
| PAO 3.6 Group IV basestock | 70.22 | 69.62 | 68.72 | 0 | 0 |
| GTL 3 Group II basestock | 12 | 12 | 12 | 12 | 12 |
| PAO 3.4 | 0 | 0 | 0 | 69.52 | 70.62 |
| PAO 150 Group IV | 0 | 0 | 1.5 | 0 | 0 |
| C8/C10 TMP ester Group V basestock | 2.4 | 2.4 | 2.4 | 0 | 0 |
| Other Additives | 9.13 | 9.13 | 9.13 | 9.13 | 9.13 |
| C3/C6 secondary ZDDP | 0.9 | 0.9 | 0.9 | 0.45 | 0.9 |
| Primary ZDDP | 0 | 0 | 0 | 0.55 | 0 |
| SI Block viscosity modifier | 2 | 2 | 2 | 4.5 | 3.5 |
| 68 TBN Ca Salicylate Detergent | 1.65 | 1.65 | 1.65 | 1.65 | 1.65 |
| 400 TBN Mg Sulfonate Detergent | 0.3 | 0.2 | 0.3 | 0.3 | 0.3 |
| 205 TBN Ca Salicylate Detergent | 1.4 | 1.4 | 1.4 | 1.4 | 1.4 |
| Polymeric EtO friction modifier | 0 | 0.7 | 0 | 0 | 0 |
| Mixed glyceride ester friction modifier | 0 | 0 | 0 | 0.5 | 0.5 |

TABLE 5

Test results for Compositions B1 to B5.

| | Comp. B1 | B2 | B3 | B4 | B5 |
|---|---|---|---|---|---|
| ASTM D2783 Load-Wear Index | 35.8 | 37 | 34 | 30.7 | 29.3 |
| ASTM D2783 Weld Point, [>] | 160 | 200 | 200 | 200 | 160 |
| ASTM D445 Kinematic Viscosity, 100° C. | 5.53 | 5.80 | 5.80 | 5.61 | 5.6 |
| ASTM D4683, HTHS 150 C. | | 2.04 | | 2.05 | |
| FZG Scuffing Test, Failure Load Stage | 4 | 5 | 7 | 5 | 5 |
| FZG Scuffing Test, Weight Loss of Wheel | 300 | 33 | 935 | 101 | 18 |

The foregoing engine oil lubricant compositions can further include any one or more of the following numbered embodiments:

1. An engine oil lubricant composition comprising a major amount of an oil basestock, about 0.1 wt % to about 5.0 wt % of a polymeric ethylene oxide friction modifier, and about 0.1 wt % to about 8.0 wt % of at least one viscosity modifier, where the weight percents are based on the total weight of the engine oil lubricant composition, and wherein the engine oil lubricant composition has a kinematic viscosity at 100° C. of 6 cSt or less, and a corrosion protection of at least 90, as measured according the ASTM D6557 Ball Rust Test.

2. The lubricant composition according to embodiment 1, wherein the lubricant composition further has an HTHS (ASTM D4683) of less than or equal to 2.2 cP at 150° C.

3. The lubricant composition according to any of the embodiments 1 or 2, wherein the at least one viscosity modifier comprises a styrenic block copolymer and the oil basestock comprises a Group I, Group II, Group III, Group IV or Group V base oil.

4. The lubricating engine oil according to any of the embodiments 1 to 3, wherein the oil basestock comprises a Group IV base oil.

5. The lubricant composition according to any of the embodiments 1 to 4, wherein the major amount of the oil basestock comprises about 69 wt % to 95 wt % of a Group IV base oil, based on the total weight of the engine oil lubricant composition.

6. The lubricant composition according to embodiment 4, further comprising about 10 to about 15 wt % of a Group II base oil, based on the total weight of the engine oil lubricant composition.

7. The lubricant composition according to embodiment 6, further comprising about 1 to about 3 wt % of a Group V base oil, based on the total weight of the engine oil lubricant composition.

8. The lubricant composition according to embodiments 6 or 7, wherein the Group II base oil has a kinematic viscosity at 100° C. of from 2 to 6 cSt.

9. The lubricant composition according to any of the embodiments 6 to 8, wherein the Group II basestock is a Gas to-Liquids (GTL) basestock.

10. The lubricant composition according to embodiment 7, wherein the Group V basestock has a kinematic viscosity at 100° C. of from 2 to 6 cSt.

11. The lubricant composition according to embodiment 7, wherein the Group V basestock has a kinematic viscosity at 100° C. of 5 cSt or less.

12. The lubricant composition according to any of the embodiments 1 to 11, further comprising one or more anti-wear additives, other viscosity modifiers, antioxidants, detergents, other dispersants, pour point depressants, corrosion inhibitors, metal deactivators, seal compatibility additives, anti-foam agents, inhibitors, anti-rust additives, or any one or more combinations thereof.

13. The lubricant composition according to any of the embodiments 1 to 12, wherein the lubricant composition further has a FZG failure load stage of at least 6, as measured by the FZG A10/16.6R/130 test procedure.

14. An engine oil lubricant composition comprising: a major amount of an oil basestock, about 0.1 wt % to about 5.0 wt % of a mixed glyceride ester friction modifier, and about 0.1 wt % to about 8 wt % of at least one viscosity modifier, where the weight percents are based on the total weight of the engine oil lubricant composition, and wherein the engine oil lubricant composition has a kinematic viscosity at 100° C. of 6 cSt or less, an HTHS (ASTM D4683) of less than or equal to 2.2 cP at 150° C. and a FZG failure load stage of at least 6, as measured by the FZG A10/16.6R/130 test procedure.

15. The lubricant composition according to embodiment 14, wherein the at least one viscosity modifier comprises a styrenic block copolymer and the oil basestock comprises a Group I, Group II, Group III, Group IV or Group V base oil.

16. The lubricating engine oil according to embodiments 14 or 15, wherein the oil basestock comprises a Group IV base oil.

17. The lubricant composition according to any of the embodiments 14 to 16, wherein the major amount of the oil basestock comprises about 69 wt % to 95 wt % of a Group IV base oil, based on the total weight of the engine oil lubricant composition.

18. The lubricant composition according to embodiment 16, further comprising about 10 to about 15 wt % of a Group II base oil, based on the total weight of the engine oil lubricant composition.

19. The lubricant composition according to embodiment 18, further comprising about 1 to about 3 wt % of a Group V base oil, based on the total weight of the engine oil lubricant composition.

20. The lubricant composition according to embodiment 18, wherein the Group II base oil has a kinematic viscosity at 100° C. of from 2 to 6 cSt.

21. The lubricant composition according to embodiment 20, wherein the Group II basestock is a Gas to-Liquids (GTL) basestock.

22. The lubricant composition according to embodiment 19, wherein the Group V basestock has a kinematic viscosity at 100° C. of from 2 to 6 cSt.

23. The lubricant composition according to embodiment 19, wherein the Group V basestock has a kinematic viscosity at 100° C. of 5 cSt or less.

24. The lubricant composition according to any of the embodiments 14 to 23, further comprising one or more anti-wear additives, other viscosity modifiers, antioxidants, detergents, other dispersants, pour point depressants, corrosion inhibitors, metal deactivators, seal compatibility additives, anti-foam agents, inhibitors, anti-rust additives, or any one or more combinations thereof.

25. An engine oil lubricant composition comprising about 65 wt % to 95 wt % of a Group IV base oil having a kinematic viscosity at 100° C. of 5 cSt or less; about 1 wt % to 5 wt % of a Group IV base oil having a kinematic viscosity at 100° C. of 100 cSt to 200 CSt; and about 10 to about 15 wt % of a Group II base oil having a kinematic viscosity at 100° C. of 5 cSt or less, wherein the weight percents are based on the total weight of the engine oil lubricant composition, and wherein the engine oil lubricant composition has a kinematic viscosity at 100° C. of 6 cSt or less, an HTHS (ASTM D4683) of less than or equal to 2.2 cP at 150° C. and a FZG failure load stage of at least 6, as measured by the FZG A10/16.6R/130 test procedure.

It will thus be seen that the objects set forth above, among those apparent in the preceding description, are efficiently attained and, since certain changes may be made in carrying out the present invention without departing from the spirit and scope of the invention, it is intended that all matter contained in the above description and shown in the accompanying drawing be interpreted as illustrative and not in a limiting sense.

Applicants have attempted to disclose all embodiments and applications of the disclosed subject matter that could be reasonably foreseen. However, there may be unforeseeable, insubstantial modifications that remain as equivalents. While the present disclosure has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

All patents, test procedures, and other documents cited herein, including priority documents, are fully incorporated by reference to the extent such disclosure is not inconsistent with this disclosure and for all jurisdictions in which such incorporation is permitted.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, meaning the values take into account experimental error, machine tolerances and other variations that would be expected by a person having ordinary skill in the art.

It is also understood that the following claims are intended to cover all of the generic and specific features of the invention herein described and all statements of the scope of the invention, which as a matter of language, might be said to fall there between.

What is claimed is:

1. An engine oil lubricant composition comprising:

a major amount of an oil basestock blend comprising a Group IV base oil and a Group II base oil, about 0.1 wt % to about 5.0 wt % of a polymeric ethylene oxide friction modifier having a weight average molecular weight from about 3,000 to about 50,000, and about 0.1 wt % to about 8.0 wt % of at least one viscosity modifier that comprises a styrenic block copolymer, where the weight percents are based on the total weight of the engine oil lubricant composition, and wherein the engine oil lubricant composition has a kinematic viscosity at 100° C. of 6 cSt or less, and a corrosion protection of at least 90, as measured according the ASTM D6557 Ball Rust Test.

2. The lubricant composition of claim 1, wherein the lubricant composition further has an HTHS (ASTM D4683) of less than or equal to 2.2 cP at 150° C.

3. The lubricant composition of claim 1, wherein the major amount of the oil basestock blend comprises about 69 wt % to 95 wt % of the Group IV base oil, based on the total weight of the engine oil lubricant composition.

4. The lubricant composition of claim 1, further comprising about 10 to about 15 wt % of a Group II base oil, based on the total weight of the engine oil lubricant composition.

5. The lubricant composition of claim 4, further comprising about 1 to about 3 wt % of a Group V base oil, based on the total weight of the engine oil lubricant composition.

6. The lubricant composition of claim 4, wherein the Group II base oil has a kinematic viscosity at 100° C. of from 2 to 6 cSt.

7. The lubricant composition of claim 4, wherein the Group II base oil is a Gas to-Liquids (GTL) basestock.

8. The lubricant composition of claim 5, wherein the Group V base oil has a kinematic viscosity at 100° C. of from 2 to 6 cSt.

9. The lubricant composition of claim 5, wherein the Group V base oil has a kinematic viscosity at 100° C. of 5 cSt or less.

10. The lubricant composition of claim 1, further comprising one or more anti-wear additives, other viscosity modifiers, antioxidants, detergents, other dispersants, pour point depressants, corrosion inhibitors, metal deactivators, seal compatibility additives, anti-foam agents, inhibitors, anti-rust additives, or any one or more combinations thereof.

11. The lubricant composition of claim 1, wherein the lubricant composition further has a FZG failure load stage of at least 6, as measured by the FZG A10/16.6R/130 test procedure.

12. The lubricant composition of claim 1, wherein the styrenic block copolymer has weight average molecular weight of about 50,000 to about 200,000.

* * * * *